US011859955B2

(12) United States Patent
Ransariya et al.

(10) Patent No.: US 11,859,955 B2
(45) Date of Patent: Jan. 2, 2024

(54) CERAMIC BULLET

(71) Applicants: Nileshbhai Balubhai Ransariya, Rajkot (IN); Dhiren Vinodkant Gandhi, Ahmedabad (IN)

(72) Inventors: Nileshbhai Balubhai Ransariya, Rajkot (IN); Dhiren Vinodkant Gandhi, Ahmedabad (IN)

( * ) Notice: Subject to any disclaimer, the term of this patent is extended or adjusted under 35 U.S.C. 154(b) by 0 days.

(21) Appl. No.: 17/629,563

(22) PCT Filed: Sep. 27, 2019

(86) PCT No.: PCT/IN2019/050712
§ 371 (c)(1),
(2) Date: Jan. 24, 2022

(87) PCT Pub. No.: WO2021/014456
PCT Pub. Date: Jan. 28, 2021

(65) Prior Publication Data

US 2022/0276033 A1 Sep. 1, 2022

(30) Foreign Application Priority Data

Jul. 22, 2019 (IN) ..... 201921029466

(51) Int. Cl.
*F42B 12/74* (2006.01)

(52) U.S. Cl.
CPC ..... *F42B 12/74* (2013.01)

(58) Field of Classification Search
USPC ..... 102/517
See application file for complete search history.

(56) References Cited

U.S. PATENT DOCUMENTS

| | | | | |
|---|---|---|---|---|
| 7,392,746 | B2 * | 7/2008 | Hansen | F42B 7/046 102/517 |
| 8,689,696 | B1 * | 4/2014 | Seeman | F42B 33/001 102/501 |
| 10,323,919 | B2 * | 6/2019 | Hash | F42B 30/02 |
| 10,578,413 | B1 * | 3/2020 | Burke | F42B 12/74 |
| 11,293,730 | B1 * | 4/2022 | Burke | F42B 12/16 |
| 2018/0154446 | A1 * | 6/2018 | Brown | F42B 10/24 |
| 2018/0321023 | A1 * | 11/2018 | Teig | F42B 33/00 |
| 2019/0017789 | A1 * | 1/2019 | Burczynski | F42B 12/74 |
| 2019/0113319 | A1 * | 4/2019 | Forsell | F42B 12/08 |
| 2020/0033102 | A1 * | 1/2020 | Burrow | F42B 12/58 |
| 2020/0248997 | A1 * | 8/2020 | McLaren | F42B 12/78 |
| 2022/0178666 | A1 * | 6/2022 | Parker | F42B 12/78 |

FOREIGN PATENT DOCUMENTS

| | | | | |
|---|---|---|---|---|
| DE | 3146155 C1 | | 5/1994 | |
| WO | WO 00/02004 | * | 1/2000 | F42B 12/72 |

OTHER PUBLICATIONS

International Search Report and Written Opinion of the International Searching Authority dated Jan. 23, 2020 in corresponding International Application No. PCT/IN2019/050712; 7 pages.

* cited by examiner

*Primary Examiner* — Samir Abdosh
(74) *Attorney, Agent, or Firm* — Maier & Maier, PLLC

(57) ABSTRACT

A ceramic bullet which is lead-free, explosive free bullets having improved and novel material and processes for producing bullets.

3 Claims, 1 Drawing Sheet

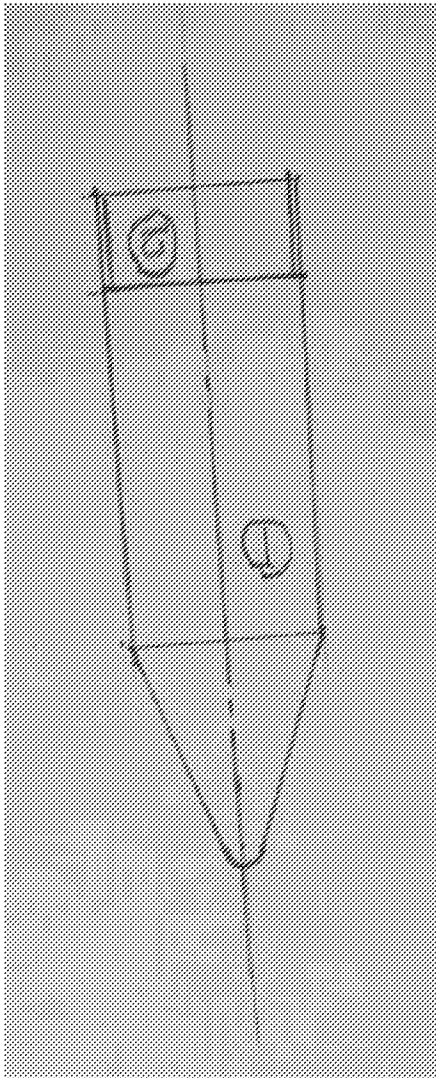

CERAMIC BULLET

FIELD OF THE INVENTION

This invention relates to a ceramic bullet which is lead-free, explosive-free bullet having improved and novel material and processes for producing these bullets. The invention is used for the defense purpose, related to the pressure intensity generated by the bullet when it strikes. The target bullet efficiency of the bullet is measured by the probability that a bullet's impact will stop an aggressive behavior and is called "stopping power".

BACKGROUND OF THE INVENTION

Traditionally, bullets for small arms ammunition have been manufactured from metals like copper, steel, lead and lead alloys. The major advantages of metal as a bullet material are associated with its relatively low cost, high density, and high ductility. The lead is widely used for bullet design because the energy generated by the weight of a bullet is important for the proper functioning of modern semi-automatic and automatic weapons, the in-flight stability of the round, and the terminal effects of the bullet.

The highly toxic nature of lead, however, its propensity to fume and generate airborne particulate, places the shooter at an extreme health risk. For the larger firing range the more lead residue builds up, and the greater the resulting lead fume and lead dust pollution particularly for indoor ranges. Moreover, the lead bullet residue left in the earthen beam of outdoor ranges can leach into the soil and contaminate water tables. In order to operate safely indoor ranges, extensive and expensive air filtration systems are required, and both indoor and outdoor ranges require constant de-leading. These cleanup operations are time consuming, costly and repetitive. Accordingly, there is a great need for lead free bullets.

To overcome such a situation, in the present invention ceramic bullet is invented.

OBJECT OF THE INVENTION

The main object of the present invention is to provide a ceramic bullet having ceramic being inert material when strikes to a live person or animal causing less damage compared to the lead base metallic bullets as conventionally used.

Another object of the present invention is to provide a ceramic bullet that is light in weight, so, as to reduce the weight of magazine and thus reducing the load on arms and shoulders. With the lightweight of the ceramic bullet, the momentum of the bullet is less so that the damage to the target person would be reduced due to less momentum.

Another object of the present invention is to provide a ceramic bullet that has a range of travel distance more than a metallic bullet and can travel long distance and create less impact to the object and therefore making the bullet safe.

Another object of the present invention is to provide a ceramic bullet having ceramic being inert material so not to cause damage to the target except piercing.

Another object of the invention is to provide a ceramic bullet made of high abrasive resistance material.

Another object of the invention is to provide a ceramic bullet having less production cost light weight and therefore the more number of bullets can be carried as compared to standard bullets.

STATEMENT OF THE INVENTION

Accordingly, the present invention facilitates the more utilization of composite materials armor in certain ballistic applications over conventional rigid metal armor systems because of superior strength-to weight ratio of the proposed ceramic bullet. The ceramic bullet has the result of the projectile damage or destruction, causing a decrease of penetration.

The present invention provides a ceramic bullet with a metallic cap at the other end where the trigger is hit.

BRIEF DESCRIPTION OF THE DRAWINGS

The structure and the technical means adopted by the present invention to achieve the above and other objects can be best understood by referring to the following detailed description of the preferred embodiments and the accompanying drawings, FIG. 1 illustrates a layout diagram of present invention.

DETAILED DESCRIPTION OF THE INVENTION

Before explaining the present invention in detail, it is to be understood that the invention is not limited in its application to the details of the construction and arrangement of parts illustrated in the accompanying drawings. The invention is capable of other embodiments, as depicted in different FIGURES as described above and of being practiced or carried out in a variety of ways. It is to be understood that the phraseology and terminology employed herein is for the purpose of description and not of limitation.

FIG. 1 illustrates the layout of the ceramic bullet. As shown in FIG. 1, the entire bullet includes 1. Solid ceramic body part and
2. Metal base cap part The solid ceramic body bullet is made of ceramic material. The composition of ceramic material depends based on the size and its application of the ceramic bullet. For the solid ceramic body bullet, the selection of the compound and related properties can vary based on the size and its application. The solid ceramic body is made by various processes and finally machined to get the required tolerance. The shape of the tip can also vary based on the requirement of design and application.

The metal base cap part (also referred to as a metallic cap) is the distal part of the bullet. T cap part is made of metal so that the thrust from the trigger is directly hit on this cap of metal.

This is a solid ceramic bullet with a metallic cap at the other end where the trigger is hit. When the proposed ceramic bullet strikes on any object, the metal part gets triggered with a force to strike the object. The main object of the present invention is to provide a ceramic bullet that is safer and can be easily entered into the target object.

Further, the ceramic bullet is made of the ceramic material that is composite/coated either with a sleeping drug or any poison so, according to the requirement of the target object. The coating of sleeping drug or the poison releases sedatives to either make the object unconscious or to kill the object with less impact force. The ceramic bullet does not contain any explosive material, therefore causing minimum infection when striked on the body and make the bullet easy transportable.

While, the invention has been described with respect to the given embodiment, it will be appreciated that many variations, modifications and other applications of the invention may be made. However, it is to be expressly understood that such modifications and adaptations are within the scope of the present invention, as set forth in the following claims.

We claim:

1. A ceramic bullet comprising:

a solid ceramic body part; and a metal base cap part, wherein the solid ceramic body part is made of a ceramic material, the metal base cap part is a distal part of the bullet, the metal base cap part is made of metal, a momentum of the ceramic bullet, due to the solid ceramic body part, is reduced which causes less damage to a target object when the bullet strikes the target object, and, upon striking, the solid ceramic body part is configured to release sedatives, coated thereon, on the target object or inside the target object.

2. The ceramic bullet as claimed in claim 1, wherein the metal base cap part is at one end of the solid ceramic body part.

3. The ceramic bullet as claimed in claim 1, wherein the ceramic material is coated with a sleeping drug or any poison to allow the bullet to release sedatives to either make the target object unconscious or to kill the target object with less impact force, when the bullet strikes the object.

* * * * *